United States Patent [19]

Juillard

[11] 3,978,898

[45] Sept. 7, 1976

[54] RAPIER LOOMS

[75] Inventor: Yves Juillard, Mulhouse, France

[73] Assignee: Societe Alsacienne de Constructions Mecaniques de Mulhouse, Mulhouse Cedex, France

[22] Filed: Mar. 14, 1975

[21] Appl. No.: 558,412

[30] Foreign Application Priority Data

Mar. 15, 1974 France ..... 74.08819

[52] U.S. Cl. ..... 139/449; 139/188 R

[51] Int. Cl.[2] ..... D03D 47/00

[58] Field of Search ..... 139/122 R, 123, 127 R, 139/130, 188 R, 190

[56] References Cited

UNITED STATES PATENTS

| | | | |
|---|---|---|---|
| 151,384 | 2/1874 | Greenleaf | 139/122 R |
| 2,134,125 | 10/1938 | Hoff | 139/122 R |
| 2,489,978 | 11/1949 | Rogers et al. | 139/188 R |
| 3,159,186 | 12/1964 | Juillard | 139/127 R |
| 3,232,320 | 2/1966 | Eilhauer | 139/122 R |
| 3,266,528 | 8/1966 | Liebchen | 139/122 R |
| 3,677,306 | 7/1972 | Atkinson | 139/188 R |

FOREIGN PATENTS OR APPLICATIONS

| | | | |
|---|---|---|---|
| 1,458,089 | 10/1966 | France | 139/123 |
| 1,763 | 1892 | United Kingdom | 139/188 R |

*Primary Examiner*—James Kee Chi

*Attorney, Agent, or Firm*—Holman & Stern

[57] ABSTRACT

A rapier loom comprises at least two rigid weft carriers, rocking lever mechanisms adapted to impart opposed reciprocatory movements to said carriers, a transverse shaft, a sley, two lateral swords carrying said sley, and means mounting said swords for oscillatory movement about said shaft, said sley being constituted by a one-piece hollow beam which extends at each side of said loom beyond the pertaining sley whereby to form two extensions one at each said side of said loom, and struts rigidly connecting each one of said two extensions to a corresponding extension of said shaft.

6 Claims, 7 Drawing Figures

44
44A
46
61
62
43
51
47
44B
2A
2
2B
42
42
37
36
38
38
39
53
54

13
15
2
5
4
1B
36
39
37
53
56
91
55
51
43
44
61
63
VI
VI
V
V

RAPIER LOOMS

FIELD OF THE INVENTION

This invention relates to rapier looms comprising at least two rigid weft carriers or weft-picking needles to which are imparted by rocking lever mechanisms, opposed reciprocatory movements above a sley which is carried by two lateral swords oscillating about a transverse shaft.

BACKGROUND OF THE INVENTION

In one known embodiment such as that described for example in French Patent Specification No. 1,290,867 by the Applicants, the sley joins the upper ends of the two swords, while the oscillating lever mechanisms for controlling two needles, namely: a needle for inserting weft up to the middle of the width of the shed, and a needle for drawing said weft out to the opposite side of the shed, are carried by two casings in the form of boxes fixed respectively on the two ends of the sley and connected with one another by a cap of said sley. Fault may be found with this assembly as not having the full rigidity desirable, especially because it has given thereto an oscillating movement of very high speed which, on modern machines, is inclined to be increased from day to day.

SUMMARY OF THE INVENTION

The object of the invention is to improve looms of this type in such manner that the oscillating level mechanism supports for actuating the needles are virtually an integral part with the sley.

To this end, according to the invention, the sley comprises a one-piece hollow beam which extends to each side of the beam beyond the corresponding sley while forming an extension rigidly connected by struts to a corresponding extension of the shaft about which the swords oscillate.

Thanks to this particular arrangement, the hollow beam which extends continuously not only over the part of the sley which carries the reed, but also beyond the latter to support the oscillating lever mechanisms for controlling the needles, constitutes a member of very high rigidity, deformations of which are practically non-existent, and in which deformations the vibrations which could nevertheless be produced are at a much greater frequency and of negligible amplitude. This beam is sufficiently rigid in order that, in the majority of cases, the reed cap could even be dispensed with, thus enabling the assembly to be lightened and dispensing with a member standing in the way of direct access to the warp threads.

This new construction also enables the castings which support the oscillating level mechanisms to be dispensed with, which casings had to be of light metal so as not to make the sley heavy, and consequently were very expensive.

The invention will be better understood on reading the description which follows and on examining the accompanying drawings which show by way of non-limiting example one embodiment of an improved loom according to the invention.

DESCRIPTION OF A PREFERRED EMBODIMENT

Figure 1:
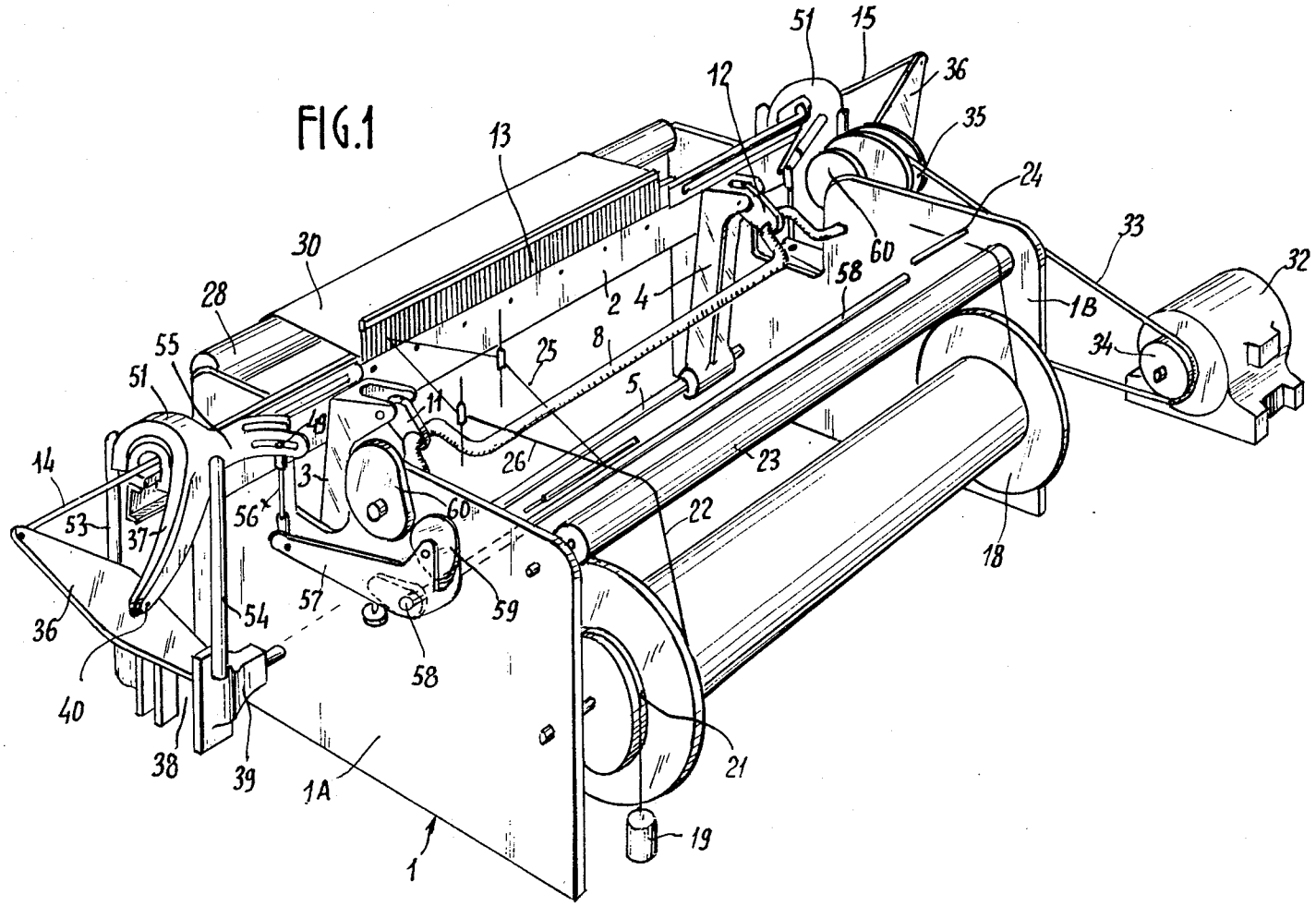
FIG. 1 is a rear perspective view of the rapier loom, the weft-picking needles being at the outer ends of their paths.

The rapier loom shown in FIG. 1, comprises essentially a frame 1, a sley 2 whose two swords 3 and 4 are supported by a lower transverse shaft 5 which is journalled in the two side plates of the frame 1, a main shaft or crank-shaft 8 which is also journalled in the side plates 1A, 1B of the frame and which is connected to the swords 3, 4 by arms 11, 12 respectively, a reed 13 supported by the sley, and two weft-picking needles, namely a weft-inserting needle 14 and a weft withdrawing needle 15.

Figure 2:
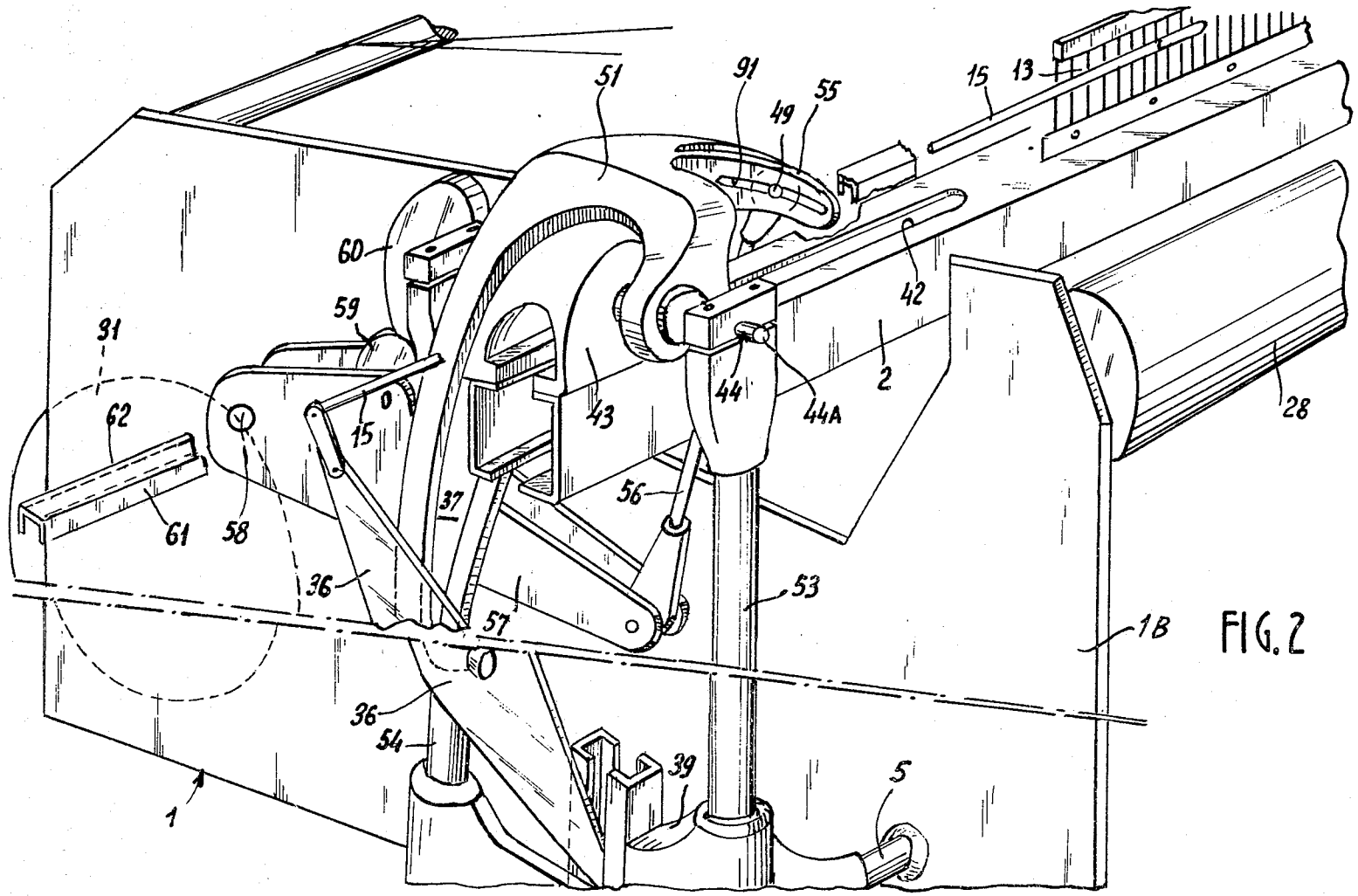
FIG. 2 shows, on a larger scale, the left-hand rocker levers for controlling the weft drawing needle, the needle being at the end of its inward path, at the moment of inerchanging.
Figure 3:
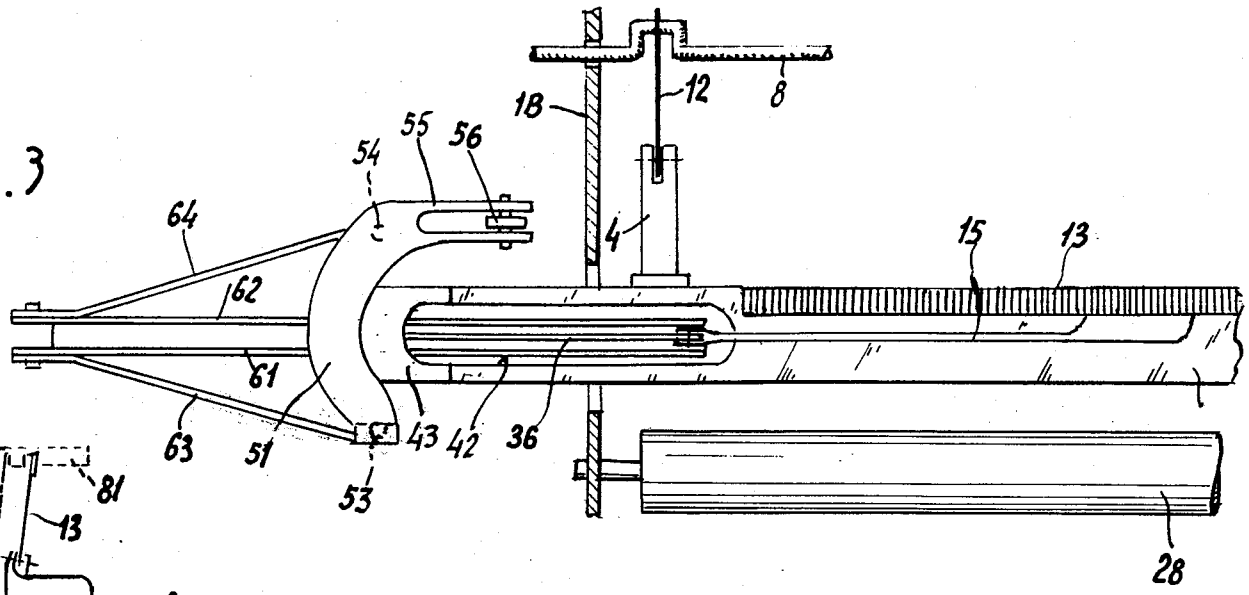
FIG. 3 is a plan view corresponding to FIG. 2.

A beam 18 for warp yarns 22 is provided with a diagrammatically represented brake mechanism in the form of a weight 19 suspended at the end of a rope passing over a pulley 21 integral with said beam. The warp yarns 22, of which two only are represented in order not to obscure the drawing, which are let off from the beam, pass over a main roller 23 and over an auxiliary roller 24, then are divided into two warp sheets, namely an upper warp sheet 25 and a lower warp sheet 26 to form the shed, while the cloth 30 passes over a winding roll 28 and is finally wound on a cylinder 31 (FIG. 2).

The crank-shaft 8 is driven from an electric motor 32 through the intermediary of a tranmission by belt 33 which passes over a pulley 34 of the motor and over a grooved pulley 35 fixed on one end of the crank-shaft 8.

The sley is constituted by a one-piece shaped hollow beam (see especially FIG. 7), which extends at each end of the beam beyond the corresponding sley 3, 4 (FIG. 1) forming an extension which supports part of the control drive mechanisms for the two needles 14 and 15.

These needle drive mechanisms are disposed in a substantially symmetrical manner in relation to the vertical longitudinal median plane of the loom. The mechanism for controlling the needle 14 comprises essentially a two-armed lever 36 and a control drive lever 37. One end of the two-armed lever 36 is freely mounted in a radial slideway 38 made in a block 39, fixed on an extension of the lower transverse shaft 5, while, on the end of the other arm of the lever 36, there is articulated by a swivel joint the rear end of the needle 14. The lower end of the control lever 37 is articulated by a spindle 40 on the two-armed lever 36 midway therealong, while the upper end of said control lever is in the form of a swan neck 51 (see also FIGS. 2 to 5), which is journalled by means of two antifriction bearing supports 46, 47 on an auxiliary shaft 44 formed in actual fact by two half-shafts 44A, 44B disposed co-axially but leaving between them a space for the upper passage of the two-armed lever 36. The two half-shafts 44A, 44B are fixed in corresponding lateral faces of a very rigid bridge-shaped member 43 which connects the two cheeks i.e., webs, flanges, or sides 2A, 2B formed by the two halves of the extension of the beam slotted over its full depth as at 42 (FIG. 5) to enable the movement of the upper part of the two-armed lever 36. The bridge-shaped member 43 conveniently crosses above the two extension cheeks of the beam. On the two ends of the two half-shafts 44A, 44B are respectively fixed, the upper ends of two struts 53, 54, the lower ends of which are fixed to the block 39.

The swan neck member 51 has an extension arm 55 (FIG. 1) connected, by a rod 56, to a lever 57 which is carried by a transverse shaft 58 journalled in the side plates of the frame 1, and which supports a disk 59 driven by a cam 60 fixed on the corresponding end of the crank-shaft 8.

Two protective strips 61, 62 (FIGS. 3 to 5) are fixed on the top of the cheeks of the split part of the beam and extend in the outward direction so as to extend over the whole length of the path of the rear end of the needle 14, without taking part in the very large forces transmitted by the lever mechanisms to the needle to impress on the latter its reciprocatory movement. The free ends of the two protective strips 61, 62 are connected by two bars 63, 64 respectively, to the two struts 53, 54.

The control drive lever 37 is slightly bent in the forward direction since its upper end is journalled on the bearing support 47 situated at right angles with the rear surface of the sley, while its lower end, articulated on the two-armed lever 36, is in the vertical longitudinal median plane of said sley.

Figure 7:
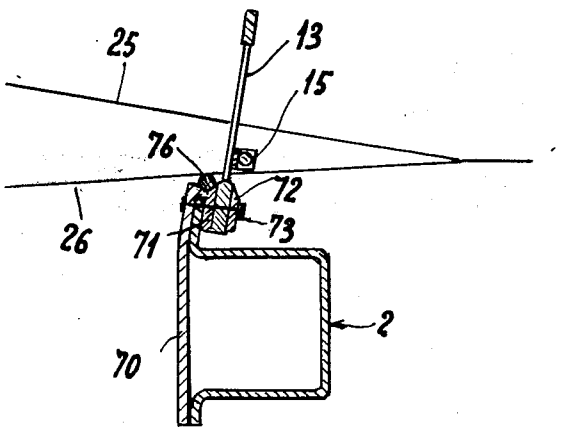
FIG. 7 shows, on a larger scale, a construction of the upper part of FIG. 6.
Figure 6:
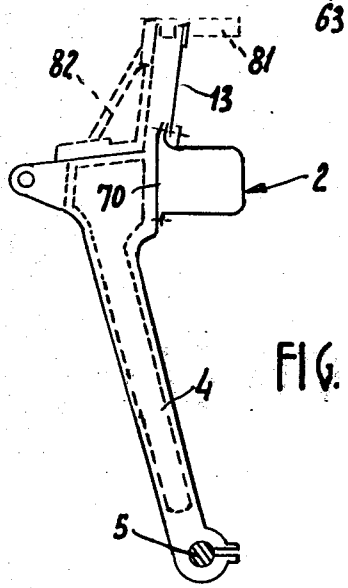
FIGS. 5 and 6 are sectional views, respectively, along the lines V—V and VI—VI of FIG. 4.

In one particular embodiment (FIG. 7), the beam which makes up the sley is constituted by a shaped member of U-section lying on its side with outwardly turned edges against which are fixed flush, by electric welding, a plate 70 (see FIGS. 6 and 7).

The covering plate 70 is not always necessary and this particular form of the sley lends itself particularly well to being without the covering plate. Reeds 30, in many applications, may even be fixed only by its lower edge, for example between a strap 71 (FIG. 7) and a counterstrap 72 secured by bolts against the upper raised edge of the beam 2. The upper edge of the strap 71, in this example, supports a glass beading 76 for supporting the sheet of lower warp yarns 26 on which the needles such as 15, slide.

In the case where it is necessary that the reed be held also by its upper edge, there may be provided a cap 81 (FIG. 6) carried by a support 82 fixed on the suitably shaped upper edge of the two swords 3 and 4.

Figures 4, 5:
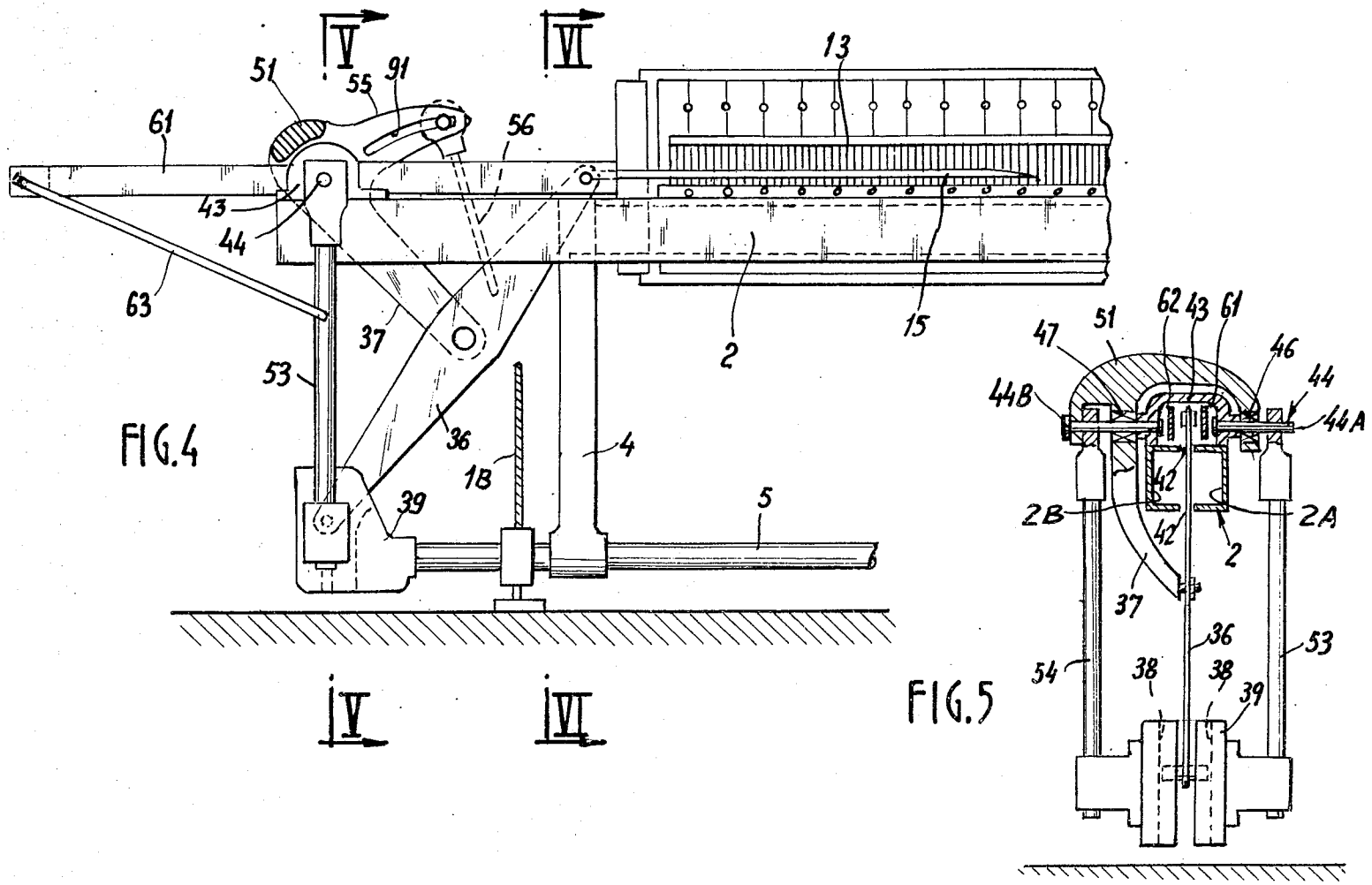
FIG. 4 is an elevation corresponding to FIG. 3.

The spindle 49 about which the upper edge of the rod 56 (FIG. 4) is articulated, is fixed in a slot 91 in the swan neck member 51 integral with the control lever 37 in such manner that it can regulate the length of the path of movement of the corresponding needle 14 or 15 by locating this spindle 49 further away or closer to the spindle 44 about which said lever is articulated. However, in order not to undergo difficulties of regulation in the obtaining of the limits of the path of movement of the two needles, at the middle of the width of the loom at the instant of exchange of the weft yarns, the slot 91 is given a configuration along the arc of a circle, the center of which is on the lower end of the rod when the oscillating lever mechanism assembly is in the extreme position corresponding to the position of its change of weft yarn as represented in FIG. 4. In these conditions, displacement of the spindle 49 of articulation of the upper edge of the rod 56 in the slot 91 has no influence whatsoever on the location of the internal end of the path of movement of the needles, and only the external ends of the path of movement are modified as a function of the cut-off desired.

The operation of the loom is as follows: the electric motor 32 drives the crank-shaft 8 from which all components of the loom are driven. The sley 2 performs a reciprocatory movement under the action of the two arms 11, 12 which connect it with the crank-shaft. The two needles 14 and 15 are actuated in synchronism, in the contrary sense, by the two oscillating lever mechanisms hereinbefore described. The cam 60 driving the needles is fixed on the crank-shaft 8 in such manner that the two needles 14 and 15 are separated to the maximum extent when they occupy the extreme forward position and, on the contrary, that they heads are in contact at the instant of exchange of the weft yarns, from one head into the other, when the sley appreciably occupies its extreme rear position. The needle heads under the effect of gravity and inertia slide in contact with the sheet of lower warp yarns and the reed 13. Each rotary cam 60 causes the corresponding lever 57 to pivot, and thus through the intermediary of the rod 56, causes the extension arm 55 to pivot, and, consequently, the control lever 37, the extremity of which carries along, in turn, the middle of the two-armed lever 36 in a movement along the arc of a circle, while the extremity of the lower arm of this lever is displaced in the radial slideway 38 and the extremity of its upper arm describes a straight line which is in alignment with the two needles.

Thanks to the special one-piece construction of the sley, there is obtained an assembly of very rigid elements to support the very large efforts brought into play by the oscillating lever mechanisms, so that it is no longer necessary to have recourse to casings fixed on the two ends of the sley, casings which were necessarily expensive since they had to be of light metal in order to reduce, as far as possible, inertial effects due to the speed of oscillatory movement of the sley which carried them. All of the elements involved which support large efforts operate in tension or in compression, so that the mechanism is no longer subject to elastic deformations by bending, prejudicial to good exchange of weft yarns in the middle of the shed, especially when the speed of operation of the loom is increased. Likewise, there is a decrease in the amplitude of vibrations, the frequencies of which are increased. Moreover, the cap which is often dangerous may be dispensed with and thus facilitates access to the warp yarns.

Naturally, the invention is not restricted to the embodiment described and shown, and modifications may be effected having regard to the applications in mind without thereby departing from the scope of the invention.

Thus, for example, the invention is also applicable to looms with several sheets of yarns.

I claim:

1. A rapier loom comprising at least two rigid weft carriers, rocking lever mechanisms adapted to impart opposed reciprocatory movements to said carriers, a transverse shaft, a sley, two lateral swords carrying said sley, and means mounting said swords for oscillatory movement about said shaft, said sley being constituted by a one-piece hollow beam which extends at each side of said loom beyond the pertaining sley forming two extensions, one at each said side of said loom, and struts rigidly connecting each one of said two extensions to a corresponding extension of said shaft.

2. A rapier loom according to claim 1, in which the connection between said shaft extension and said beam comprises two auxiliary coaxial half-shafts which comprise a portion of said rocking lever mechanism and which are supported by said beam.

3. A rapier loom according to claim 2, in which each of said two extensions of said beam has a longitudinal slot which extends over the full depth of said beam and through which passes one of said oscillating levers connected to the corresponding carrier, said slit extensions of said beam defining two cheeks, one on each side of said slot, a very rigid bridge-shaped member connecting said cheeks to one another, said auxiliary half-shafts being journalled in said bridge-shaped member and being connected to said shaft extension.

4. A rapier loom according to claim 3, in which the mechanism controlling each needle comprises a driving lever of which one end oscillates about the axis of said auxiliary half-shafts of the oscillatory lever mechanism, while its other end is articulated at a point intermediate the length of a two-armed lever of which one arm is articulated on the rear end of the needle while the end of its other arm is guided in a radial slideway supported by the corresponding extension of the shaft about which the swords oscillate, said driving lever comprising a part of swan-neck shape portion which passes above said bridge-shaped member and which oscillates about said auxiliary shaft of said rocking lever mechanism made up of two half-shafts fixed respectively in the two side pieces of said bridge-shaped member and on the extremities of which are attached the struts connected to the corresponding extension of the shaft about which the swords oscillate, the part of the arm of said two-armed lever connected to the carrier moving in the slot in the beam while said driving lever goes past one side of the latter.

5. A loom according to claim 1, in which a reed is supported only by a lower edge fixed rigidly to the upper face of the beam.

6. A rapier loom comprising at least two rigid weft carriers;

rocking lever mechanisms adapted to impart opposed reciprocatory movements to said weft carriers;

a transverse shaft;

a sley;

two lateral swords carrying said sley;

means mounting said swords for oscillatory movement about said shaft, said shaft having a shaft extension at each end thereof, said sley being constituted by a one-piece hollow beam which extends at each side of said loom beyond the pertaining sley forming two sley extensions, one at each side of said loom, each said sley extension having a longitudinal slot which extends over the full thickness of said sley extension forming two cheeks;

a very rigid bridge-shaped member having two side portions and connecting said cheeks to one another;

each said rocker lever mechanism comprising a driving lever having an upper portion and a lower portion, said upper portion of said driving lever being located on one side of said beam and terminated into a swan-neck shaped portion which passes above said bridge-shaped member;

two coaxial half-shafts fixed respectively in said two side portions of said bridge-shaped member, said swan-neck shaped portion of said driving lever oscillating respectively about said two coaxial half-shafts;

struts rigidly connecting said half-shafts to said shaft extension;

a two armed-lever, one arm of which is articulated on the weft-carrier and is movable through said slot of said sley extension, said lower portion of said driving lever being articulated at a point intermediate the length of said two-armed-lever;

and a radial slideway supported by each said shaft extension, the other arm of said two armed-lever being guided in said radial slideway.

* * * * *